US010779652B2

(12) United States Patent
Chen et al.

(10) Patent No.: US 10,779,652 B2
(45) Date of Patent: Sep. 22, 2020

(54) SWINGABLE BODY CARRIER

(71) Applicant: Ko-Po Chen, Taichung (TW)

(72) Inventors: Ko-Po Chen, Taichung (TW); Meng-Lung Fang, Taichung (TW)

(73) Assignee: Ko-Po Chen, Taichung (TW)

( * ) Notice: Subject to any disclaimer, the term of this patent is extended or adjusted under 35 U.S.C. 154(b) by 0 days.

(21) Appl. No.: 16/225,113

(22) Filed: Dec. 19, 2018

(65) Prior Publication Data

US 2020/0196760 A1 Jun. 25, 2020

(51) Int. Cl.
*A47C 3/025* (2006.01)

(52) U.S. Cl.
CPC ..... *A47C 3/0251* (2018.08)

(58) Field of Classification Search
CPC ..... A47C 3/0251; A47C 3/0255; A47D 13/10
See application file for complete search history.

(56) References Cited

U.S. PATENT DOCUMENTS 3,112,814 A * 12/1963 Di Pasqua ..... F03G 1/00 185/37
5,139,462 A * 8/1992 Gabe ..... A47C 3/0255 472/119
2011/0049963 A1* 3/2011 Shih ..... A47C 1/0345 297/85 M
2013/0184088 A1* 7/2013 Haut ..... A47D 13/10 472/119
2016/0029800 A1* 2/2016 Bryant ..... A47C 1/034 297/284.3
2016/0106215 A1* 4/2016 Crum ..... A47C 1/03211 297/68
2018/0027965 A1* 2/2018 Lawson ..... A47C 1/0342

FOREIGN PATENT DOCUMENTS

EP 2189144 A1 * 5/2010 ..... A47C 3/0255
EP 3536193 A1 * 9/2019 ..... A47C 3/027
TW M429416 U 5/2012
TW M561459 U 6/2018

* cited by examiner

*Primary Examiner* — Timothy J Brindley
(74) *Attorney, Agent, or Firm* — Alan D. Kamrath; Karin L. Williams; Mayer & Williams PC

(57) ABSTRACT

The present disclosure provides a swingable body carrier for hanging a swingable seat upon a base through swing arms and pushing the swingable seat to move reciprocatingly by a power assembly. Then, a carrying assembly, which is provided for carrying a body, is disposed upon the swingable seat. When a user sits or lies on the swingable body carrier of the present disclosure, it serves like a cradle to automatically swing so as to provide a good and comfortable user experience.

9 Claims, 10 Drawing Sheets

SWINGABLE BODY CARRIER

FIELD OF THE INVENTION

The present disclosure relates to a body carrier, such as a power-driven bed or a power-driven chair.

BACKGROUND OF THE INVENTION

Due to the busy modern life, people always want to lay down comfortably after work. Many people will lay on a swingable chair, massage chair or swingable bed to relieve the weariness and pressure at work. Although there are many swingable chairs in the market, the user needs to swing by themselves and keep the swingable chair swinging.

As mentioned above, such the swingable chair needs to be swung by the user. Once the user stops swinging the swingable chair for a while, the swingable chair will also stop swinging due to a mutual elimination between inertia and obstruction. Then, the user needs to swing the swingable chair again and thus it will be burden for user.

A massage chair with an automatic swinging function can be referred to Taiwan utility model patent TWM429416. The automatic swinging equipment includes a base and a seat body pivoted to the base. The base is further combined with a driving device and an eccentric wheel transmission mechanism. A linkage is then provided for connecting the eccentric wheel transmission mechanism and the seat body to allow the driving device, the eccentric wheel transmission mechanism and the linkage to drive the seat body to swing. Thus, the massage chair, which does not need to be swung by the user, that is, can swing automatically, is provided.

Except for the abovementioned massage chair, a power-driven bed, which can move reciprocatingly, is provided in Taiwan utility model patent TWM561459. The power-driven bed includes a base, a shelf and a connecting member. The shelf is configured to the above of the base through the connecting member or another sliding frame assembly and driven to move reciprocatingly by using a pulley assembly, a crankshaft and a swing arm.

SUMMARY OF THE INVENTION

In the currently existing mechanism, the reciprocating movement structure can be power-driven. However, the swing method cannot satisfy the user's need. As to the massage chair provided in Taiwan utility model patent TWM429416, it swings up and down using a base of the chair as an axis so as to give a horse-riding feel to the user. If there is no suitable frequency and margin of the swing, the user will feel uncomfortable. As to the reciprocating movement structure provided in Taiwan utility model patent TWM561459, it only swings horizontally or swings forward and downward, backward and downward. However, such the swing method is different from the user preferred.

Second, an angle of the chair back of the swing chair was fixed in the past. Thus, the user cannot lower the chair back to get a relaxed experience.

According to one aspect of the present disclosure, a swingable device, which can be power-driven to swing, is provided and has a new swing method.

According to another aspect of the present disclosure, a swingable device is provided for a user to freely adjust a riding pose so as to achieve a better user experience.

To achieve the abovementioned purposes, the present disclosure provides a swingable body carrier including a base, a reciprocating assembly, a power assembly and a carrying assembly. The base has a plurality of connecting portions. The reciprocating assembly has a plurality of swing arms and a swingable seat, in which each of the swing arms has one end pivoted to the connecting portion and the other end extended downwardly to be pivoted to the swingable seat. The power assembly provides a reciprocating power to allow the swingable seat moving reciprocatingly corresponding to the base and to allow the swing arms swinging reciprocatingly. The carrying assembly is provided for carrying a body, disposed at the swingable seat to move reciprocatingly along with the swingable seat and located above the swingable seat.

In some embodiments, the swing arms can be arranged in parallel with one another.

In some embodiments, a swinging area resulted from the reciprocatingly swinging of the swing arms is capable of having a swing angle not greater than 30 degrees.

In some embodiments, the power assembly can be connected between the base and the swingable seat.

In some embodiments, the base can further comprise a frame, a plurality of posts and two connecting rods. The frame is located lower than the swingable seat. In particular, each of the posts is mounted on the frame and extended upwardly. More particularly, the posts are arranged in surrounding the swingable seat. The two connecting rods are separately mounted to the ends of the posts and parallel to each other. The connecting portions are discretely disposed at the two connecting rods.

In some embodiments, the carrying assembly can comprise a transmission linkage, a power-driven retractable rod, a seat frame and a seat frame linkage. One end of the transmission linkage is pivoted to the swingable seat. The power-driven retractable rod is pivoted between the other end of the transmission linkage and the swingable seat. A length of the power-driven retractable rod can be changed so as to drive the transmission linkage to swing. The seat frame has one end pivoted to the swingable seat, and the seat frame linkage is pivoted between the seat frame and the transmission linkage. Thus, the seat frame linkage and the seat frame can be driven to swing when the transmission linkage swings.

In some embodiments, the transmission linkage can comprise a body and two pivoting seats. The body has an upper portion and a lower portion, in which the lower portion is pivoted to the swingable seat. The two pivoting seats are connected to the front side and the rear side of the upper portion of the body. The power-driven retractable rod and the seat frame linkage are pivoted to the same pivoting seat, and the seat frame linkage is extended nonlinearly.

In some embodiments, the carrying assembly can further comprise a back frame and a back frame linkage assembly. The back frame is pivoted to the seat frame, and the back frame linkage assembly includes a first linkage, a second linkage and a third linkage. One end of the first linkage, one end of the second linkage and one end of the third linkage are pivoted together. The other end of the first linkage is pivoted to the back frame, the other end of the second linkage is pivoted to the seat frame, and the other end of the third linkage is pivoted to the transmission linkage.

In some embodiments, the carrying assembly can further comprise a crossed linkage assembly, a foot frame and a foot frame linkage. The crossed linkage assembly has a proximal portion pivoted to the seat frame and a distal portion pivoted to the foot frame. The crossed linkage assembly can further comprise a supporting portion, and the foot frame linkage is pivoted between the supporting portion and the transmission linkage.

In some embodiments, the supporting portion is located between the proximal portion and the distal portion.

Accordingly, the swingable body carrier provided in the present disclosure can hang the swingable seat in the air and provide a carrying assembly for riding. The power assembly can push the swingable seat, and then the carrying assembly serves like a cradle or a swing chair to reciprocatingly swing so as to provide a good user experience.

In the meanwhile, a linkage mechanism is configured in the carrying assembly for adjusting the angle of the chair or the chair back. Thus, a user can freely adjust a riding pose so as to achieve a better user experience.

BRIEF DESCRIPTION OF THE DRAWINGS

The present disclosure can be more fully understood by reading the following detailed description of the embodiment, with reference made to the accompanying drawings as follows.

DETAILED DESCRIPTION OF THE INVENTION

Figure 1:
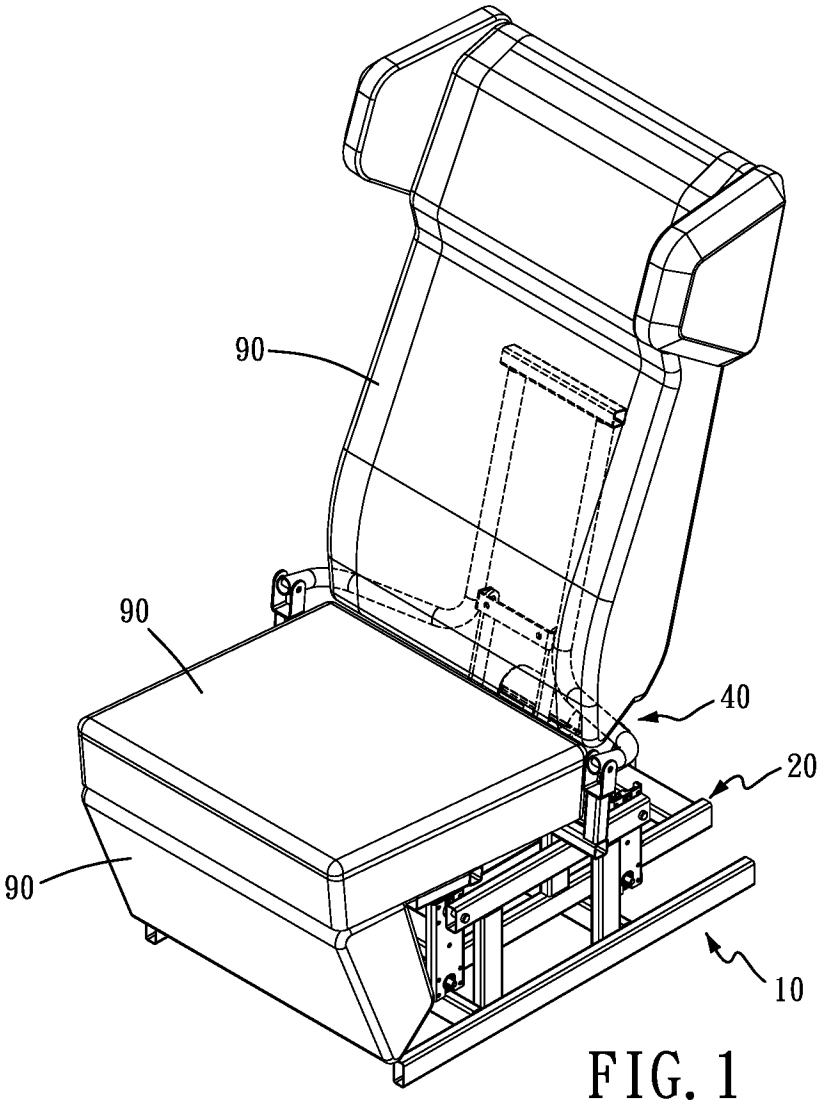
FIG. 1 is a three dimensional view of a swingable body carrier according to the present disclosure after a cushion is assembled thereon.
Figure 2:
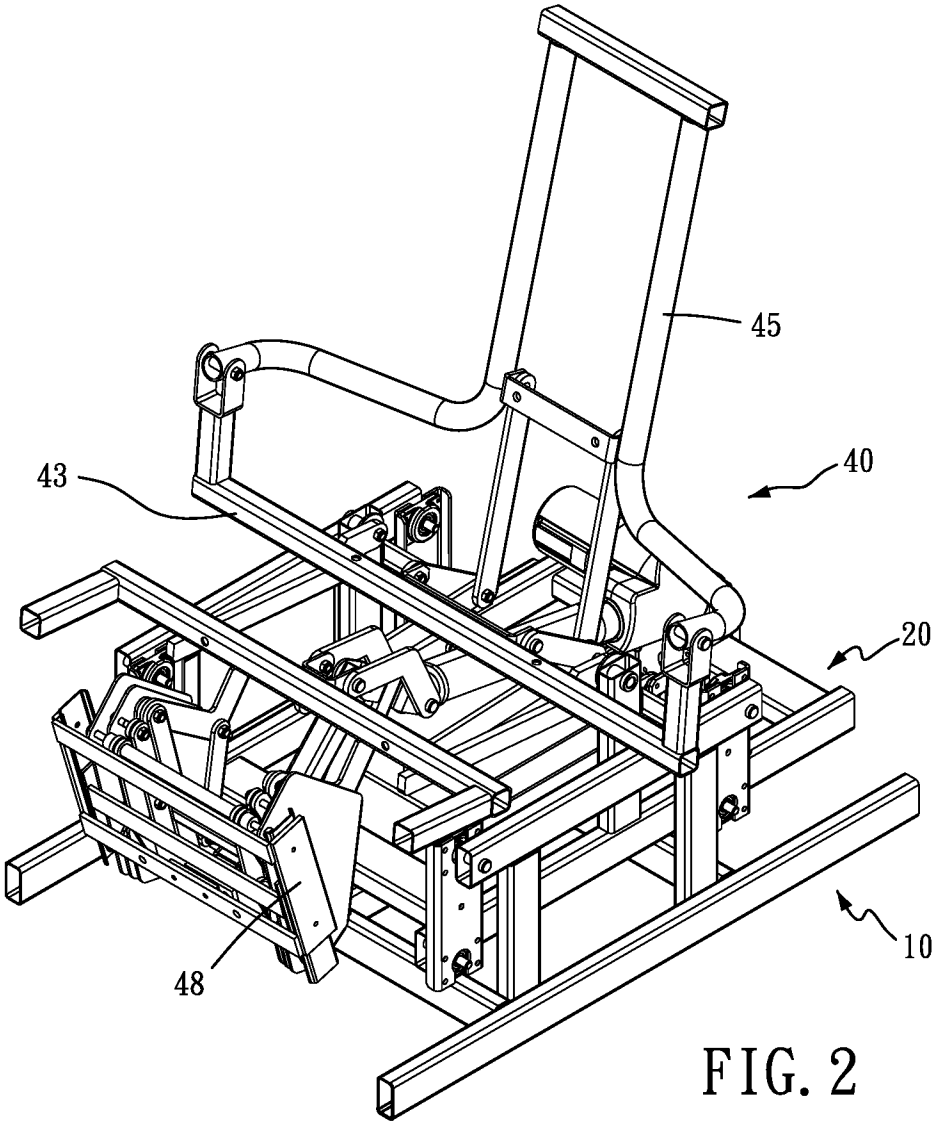
FIG. 2 is a three dimensional view of the swingable body carrier according to the present disclosure.
Figure 3:
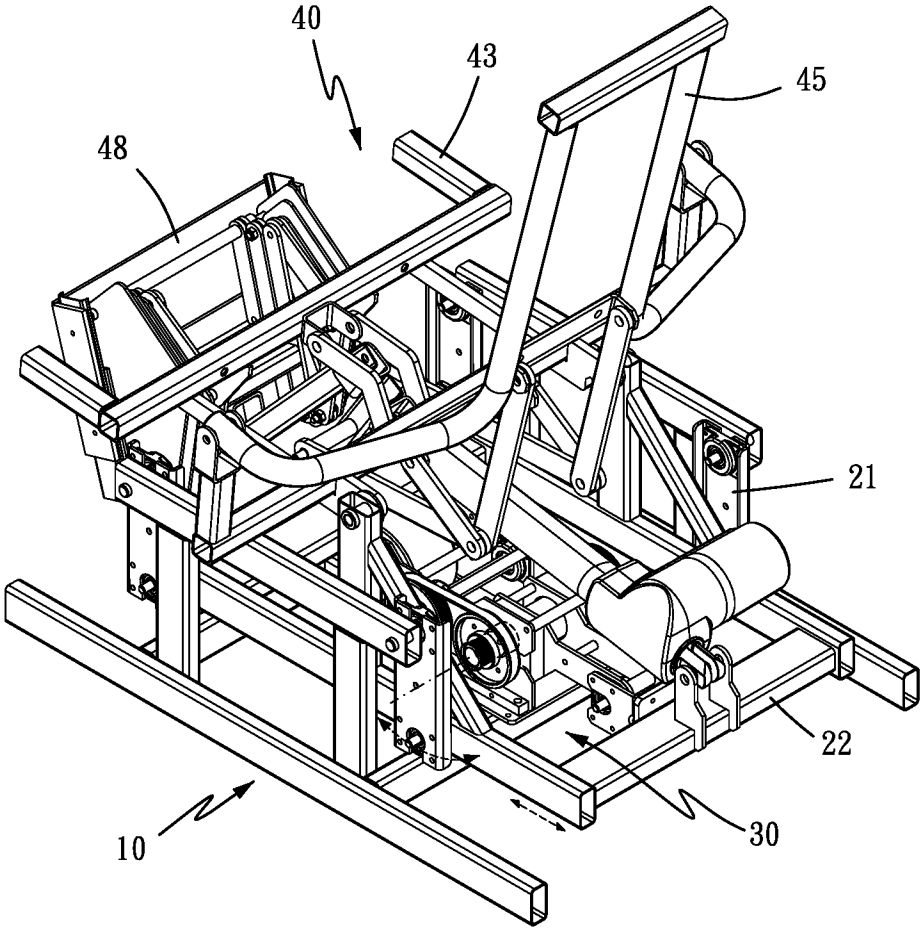
FIG. 3 is a three dimensional view of the swingable body carrier according to the present disclosure in another view angle.
Figure 4:
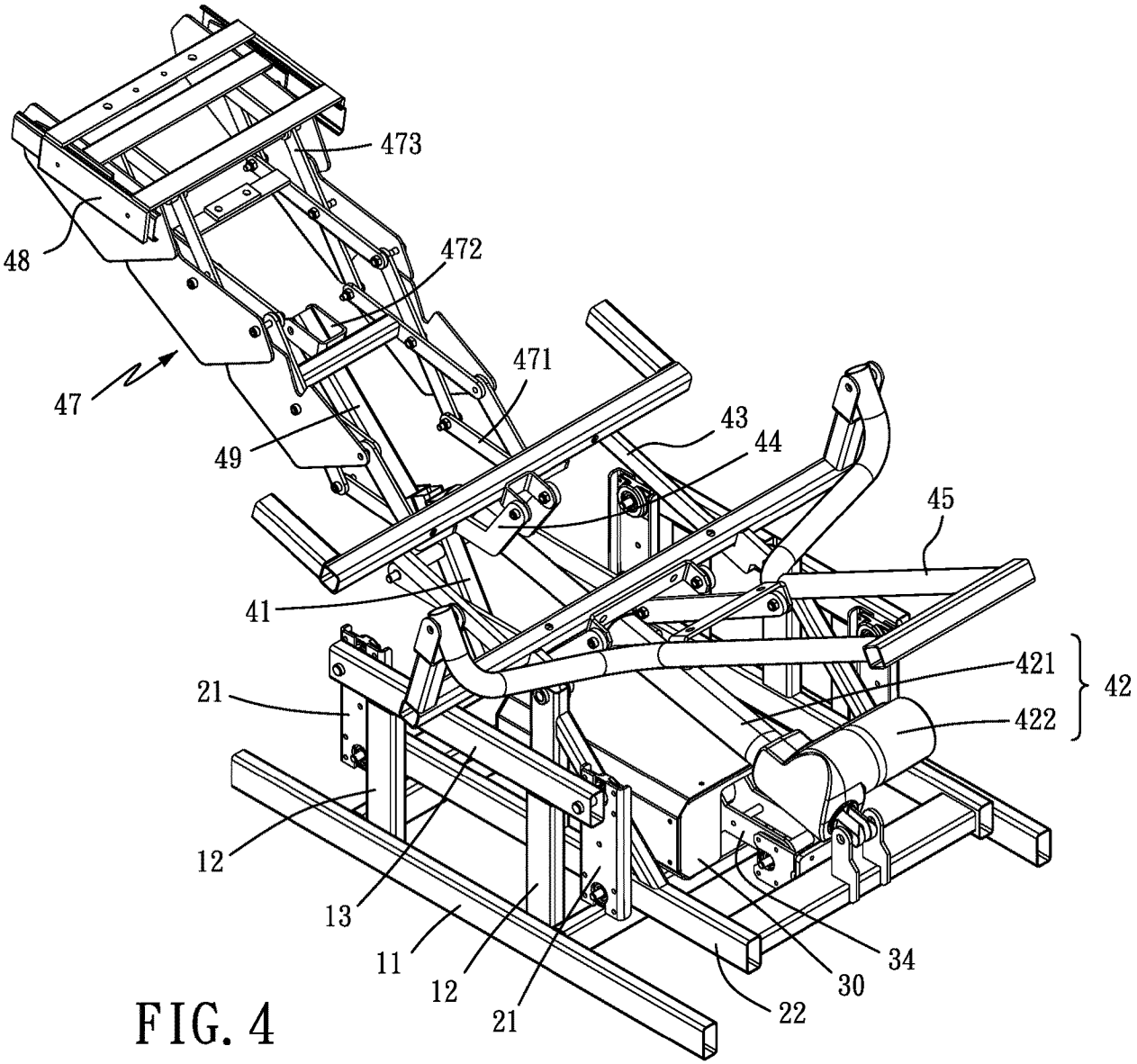
FIG. 4 is a three dimensional view of the swingable body carrier according to the present disclosure after adjusting a pose.
Figure 5:
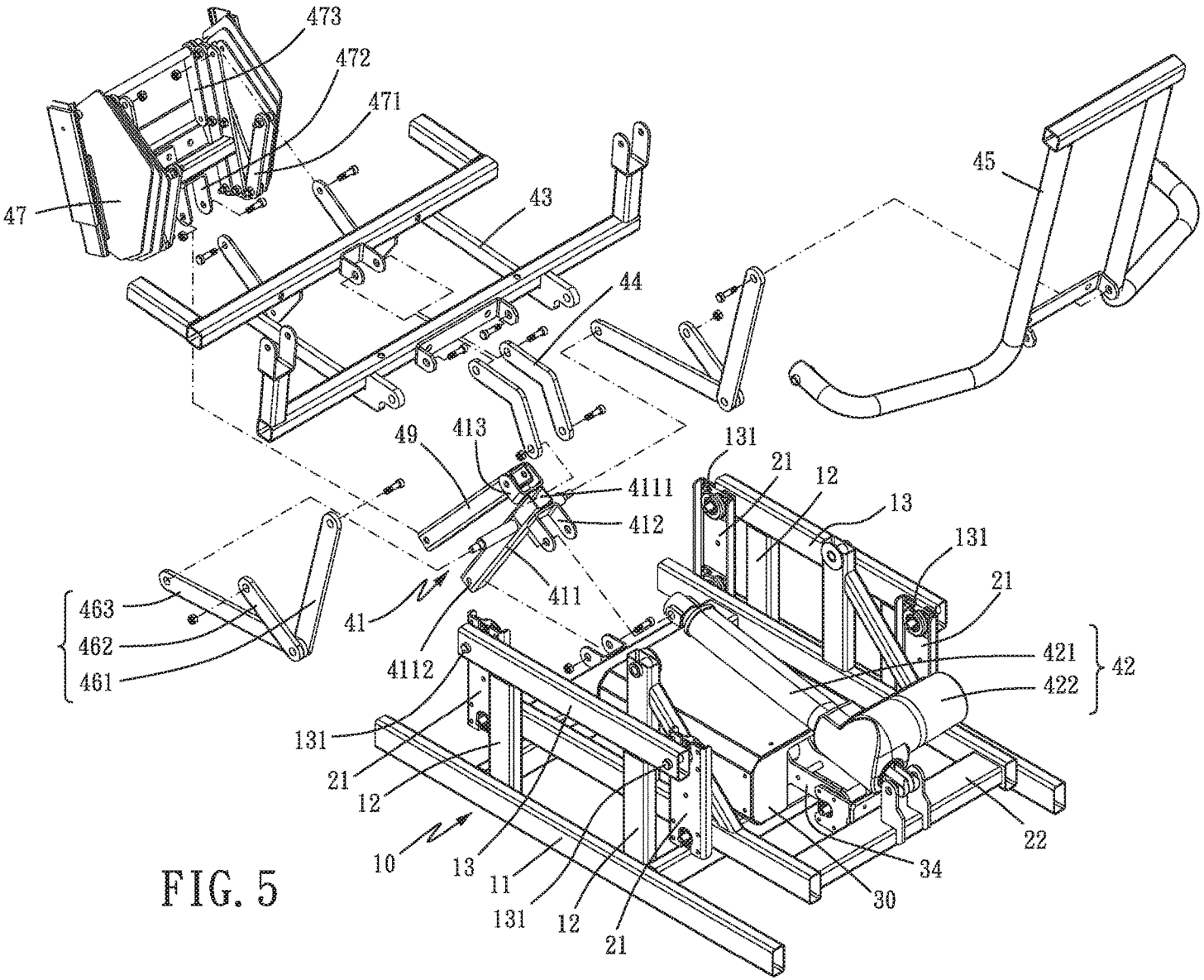
FIG. 5 is a three-dimensional exploded view of the swingable body carrier according to the present disclosure.

Please refer to FIG. 1 and FIG. 2, a swingable body carrier is provided in an example of the present disclosure, such as a power-driven chair. The power-driven chair can be wrapped by several cushions 90 for improving the user experience when the user sits or lies thereon. Please refer to FIG. 2, FIG. 3, FIG. 4 and FIG. 5, the swingable body carrier includes a base 10, a reciprocating assembly 20, a power assembly 30 and a carrying assembly 40.

The base 10 includes a frame 11, a plurality of posts 12 and two connecting rods 13. The base 11 is located at the bottom of the base 10 for being placed on the ground. Several rods or tubes can be welded or screwed to be constructed as the frame 11, or the frame 11 can be an integrated H-shaped frame. The posts 12 are mounted at the frame 11 and extended upwardly. In particular, the posts 12 are located at two sides of the frame 11, and more particularly there are two posts 12 located at each of the two sides of the frame 11. The two connecting rods 13 are separately mounted at two ends of each post 12. The two connecting rods 13 are parallel to each other and located separately at the two sides of the frame 11. Each end of the connecting rod 13 is pivoted to a connecting portion 131 for being pivoted with other members. In some embodiments, the formation and the appearance of the frame and the posts may be changed, that is, the base 10 can be a frame which is a part of other device or in other form. However, the base 10 still needs at least one connecting portion 131 for being pivoted with other members.

The reciprocating assembly 20 has a plurality of swing arms 21 and a swingable seat 22, in which each of the swing arms 21 has one end pivoted to the connecting portion 131 and the other end extended downwardly to be pivoted to the swingable seat 22. The swing arms 21 and the swingable seat 22 are located between the two connecting rods 13 to allow the posts 12 to be arranged in surrounding the swingable seat 22. Preferably, a length of the swing arm 21 is not longer than that of the post 12. Thus, a height of the swingable seat 22 is between the frame 11 and the connecting rods 13 so that the swingable seat 22 can be hanged upon the frame 11 by using the swing arms 21. The swing arms are all extended vertically downward to allow the swing arms 21 to be arranged in parallel with one another. The swingable seat 22 is provided to be assembled with the carrying assembly 40. Several rods or tubes can be welded or screwed to obtain the swingable seat 22, and the swingable seat 22 can be a rectangular frame.

Figure 6:
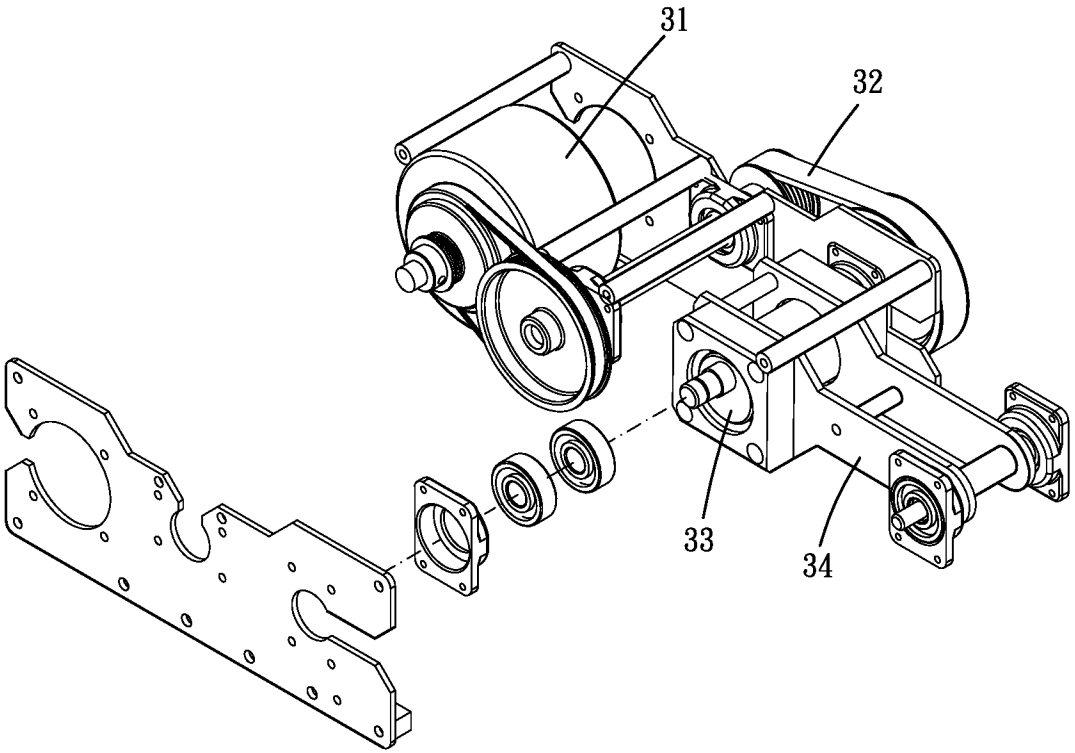
FIG. 6 is a three-dimensional exploded view of a power assembly of the swingable body carrier according to the present disclosure.
Figure 7:
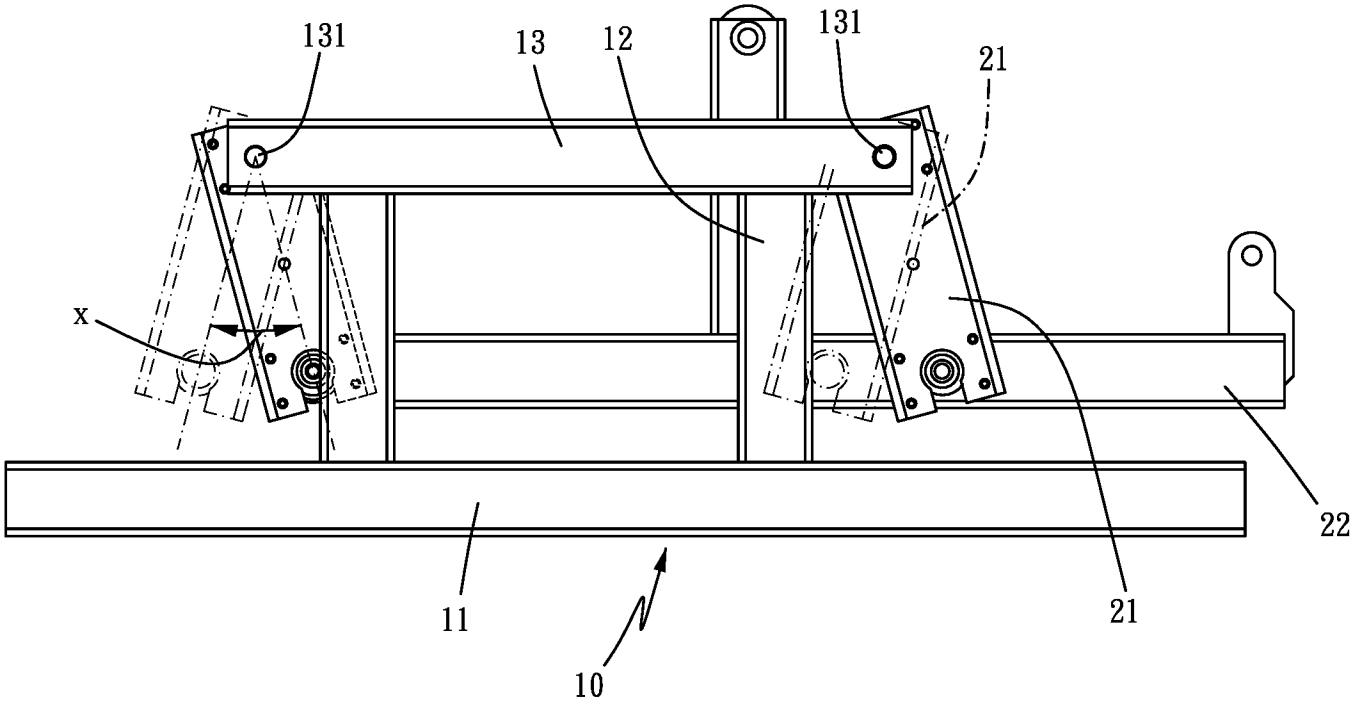
FIG. 7 is a three-dimensional exploded view of a base and a reciprocating assembly of the swingable body carrier according to the present disclosure.

The power assembly 30 is positioned between the swingable seat 22 and the frame 11. Thus, a reciprocating power can be provided from the base 10 to push the swingable seat 22 moving forward and backward, that is, the swingable seat 22 moves reciprocatingly corresponding to the base thus to allow the swing arms swinging reciprocatingly. Please refer to FIG. 6, the power assembly 30 includes a motor 31, a pulley assembly 32, a cam 33 and a pushing rod 34. The pulley assembly 32 is positioned between the motor 31 and the cam 33. The front end and the rear end of the pushing rod are connected, respectively, to the cam 33 and the rear end of the swingable seat 22. After the motor 31 is powered on, the pulley assembly 32 drives the cam 33 to rotate so as to allow the pushing rod 34 to move reciprocatingly and swing. Thus, the pushing rod 34 drives the swingable seat 22 to swing reciprocatingly. Please refer to FIG. 7, the size and the stroke of the cam 33 and the pushing rod 34 can be predetermined and cooperated with the length of the swing arms 21. Thus, a sector area resulted from the reciprocatingly swinging in a vertical plane of the swing arms 21 is formed. Preferably, the sector area has a swing angle x not greater than 30 degrees so as to obtain a comfortable swinging margin of the swing arms 21 and the swingable seat 22 without over swinging.

Referring to FIG. 2, FIG. 3, FIG. 4 and FIG. 5, the carrying assembly 40 is disposed at the swingable seat 22 to move reciprocatingly along with the swingable seat 22. In particular, the carrying assembly 40 is located above the swingable seat 22 and includes a transmission linkage 41, a power-driven retractable rod 42, a seat frame 43, a seat frame linkage 44, a back frame 45, a back frame linkage assembly 46, a crossed linkage assembly 47, a foot frame 48 and a foot frame linkage 49.

The transmission linkage 41 includes a body 411, which has an upper portion 4111 and a lower portion 4112, and two pivoting seats 412, 413. The two pivoting seats 412, 413 can be screwed or welded to the front side and the rear side of the upper portion 4111. The lower potion 4112 of the body 411 is pivoted to the front end of the swingable seat 22. The power-driven retractable rod 42 is pivoted between the pivoting seat 412 and the rear end of the swingable seat 22.

A length of the power-driven retractable rod 42 can be changed so as to drive the transmission linkage 41 to swing. The power-driven retractable rod 42 can be built up by a pneumatic cylinder 421 and a compressor 422. The compressor 422 can be power-driven to bring the air into the pneumatic cylinder 421 or expel the air to the environment so as to change its length. However, a combination of a motor and a screw assembly is also available in the present disclosure.

The rear end of the seat frame 43 is pivoted to the swingable seat 22, and the seat frame linkage 44 is pivoted between the front end of the seat frame 43 and the pivoting seat 412. The transmission linkage 41 swings to allow the seat frame linkage 44 swinging so as to lift or lower the front end of the seat frame 43. Thus, a tilt angle of the seat frame 43 will be changed. The seat frame linkage 44 includes two rods arranged side by side, and the two rods are pivoted, respectively, to the right side and the left side of the pivoting seat 412. Preferably, the seat frame linkage 44 is extended nonlinearly, that is, bent so that the seat frame linkage 44 and the transmission linkage 41 will not be interfered and against with each other during the swing.

A lower end of the back frame 45 is pivoted to the seat frame 43. The back frame linkage assembly 46 includes a first linkage 461, a second linkage 462 and a third linkage 463. The first linkage 461 has one end connected to the back frame 45, the second linkage 462 has one end connected to the seat frame 43, and the third linkage 463 has one end connected to the transmission linkage 41. The other end of the first linkage 461, the other end of the second linkage 462 and the other end of the third linkage 463 are pivoted together so that the transmission linkage 41 can swing to drive the back frame linkage assembly 46 and further drive the back frame 45 to swing together.

Several linkages are pivoted in cross to obtain the crossed linkage assembly 47, which can be pushed to pivot and elongate. The crossed linkage assembly 47 has a proximal portion 471, a supporting portion 472 and a distal portion 473. The proximal portion 471 is pivoted to the seat frame 43, and the supporting portion 472 is located between the proximal portion 471 and the distal portion 473. The foot frame 48 is pivoted to the distal portion 473. The foot frame linkage 49 is pivoted between the supporting portion 472 and the pivoting seat 413 of the transmission linkage 41. When the transmission linkage 41 swings, the supporting portion 472 can be pushed or pulled by the foot frame linkage 49. Thus, the crossed linkage assembly 47 will stretch and swing at the same time so as to drive the foot frame 48 which is connected to the distal portion 473.

Figure 8:
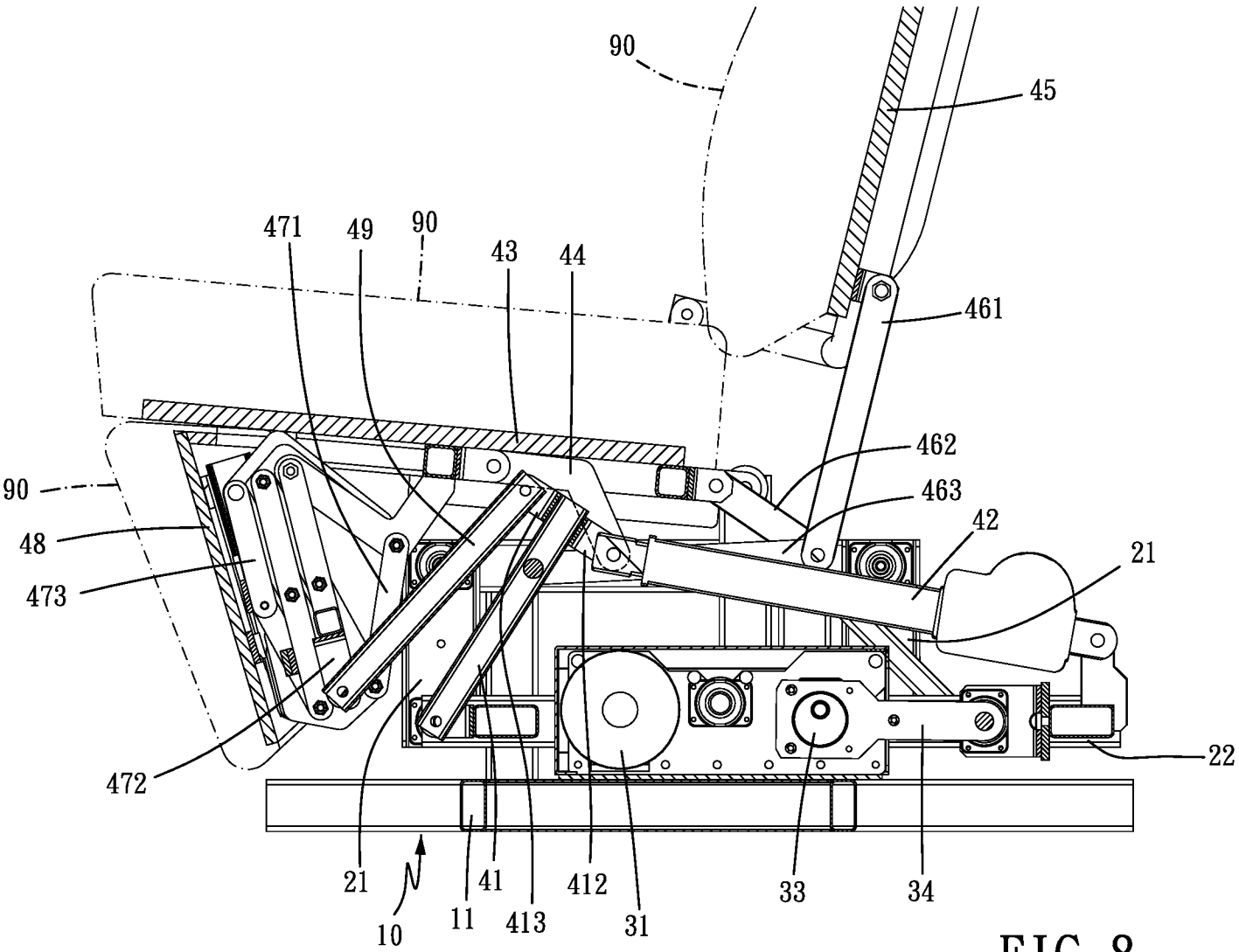
FIG. 8 is a side cross-sectional view of the swingable body carrier according to the present disclosure.
Figure 9:
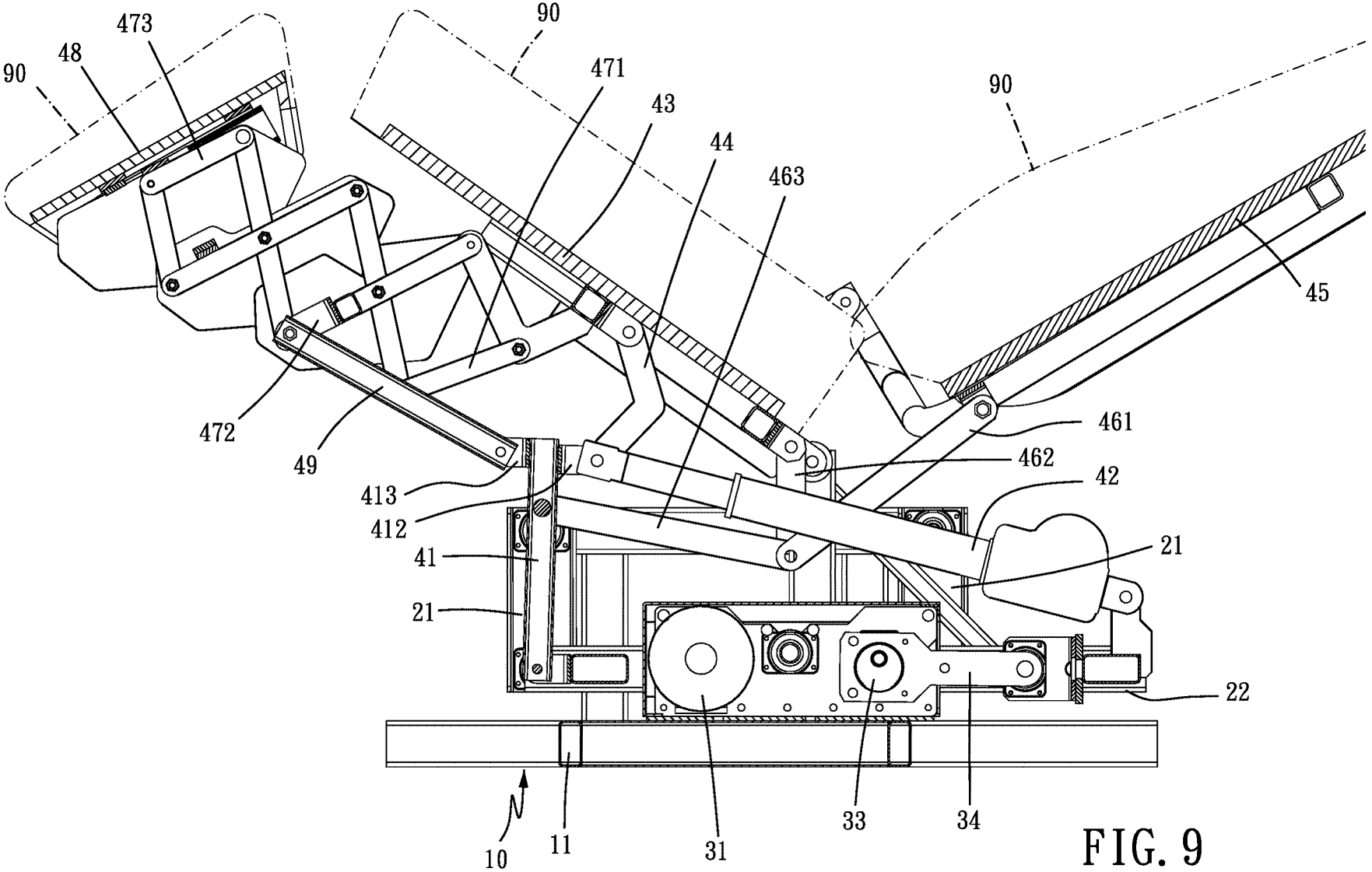
FIG. 9 and FIG. 10 are schematic diagrams showing the operation of adjusting a pose of the swingable body carrier according to the present disclosure.

Referring to FIG. 8 and FIG. 9, the back frame 45, the seat frame 43 and the foot frame 48 can be wrapped by the cushion 90 for carrying the body. The user can control the power-driven retractable rod 42 to elongate for driving the transmission linkage 41 to swing. Then, the transmission linkage 41 drives the back frame linkage assembly 46, the seat frame linkage 44 and the foot frame linkage 49 to swing together when sitting on the carrying portion 40. The third linkage 463 of the back frame linkage assembly 46 will be drawn to move forward to allow the first linkage 461 and the second linkage 462 to swing downward, and therefore, the back frame 45 will pivot backward and lie down gradually. The seat frame linkage 44 swings to push the front end of the seat frame 43 upward and thus the seat frame 43 will tilt gradually to allow the head and the back of the user to tilt backward a little bit. When the transmission linkage 41 swings forward, the foot frame linkage 49 is pushed so as to push the crossed linkage assembly 47. Thus, the crossed linkage assembly 47 pivots and elongates for pushing the foot frame 48 to swing forward.

Figure 10:
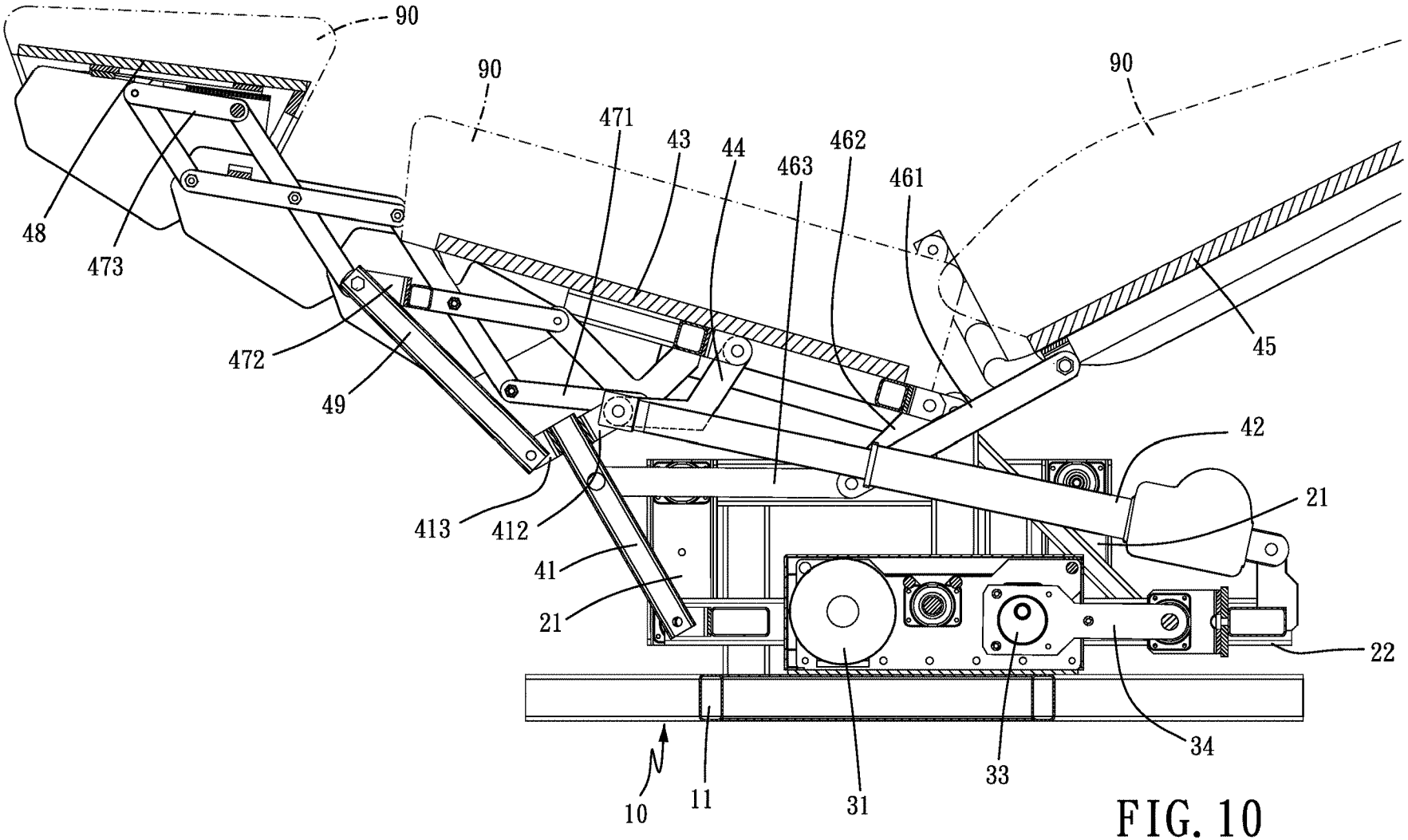

When the transmission linkage 41 keeps swinging to allow the seat frame linkage 44 to be completely upright and still swings forward, the top of the seat frame linkage 44 is over the highest point so that the seat frame linkage 44 will drive the front end of the seat frame 43 to swing downward as shown in FIG. 9 and FIG. 10. Thus, a tilt angle of the seat frame 43 will be gradually reduced. The back frame 43 continues to pivot backward and lay down at that time, and the foot frame 48 keeps swinging forward. Thus, the user can lay down after the tilt angle of the seat frame 43 is reduced.

In the elongation of the power-driven retractable rod 42, the user can turn off the power-driven retractable rod 42 depending on his/her preference so that the carrier will stop at a specific angle and pose. In the meanwhile, the power assembly can be switched on to drive the swingable seat to reciprocatingly move together with the carrying assembly for providing an operation of reciprocatingly swing.

The swingable seat is hanged by the swing arm to move forward and backward using a horizontal pose without rotation so that the operation of reciprocatingly swing can be achieved as mentioned above. In the reciprocatingly movement, level heights at the front end and the rear end will raise a little bit thus to allow the swingable seat and the carrying assembly to present like a swing route of the cradle. Thus, a good and comfortable user experience will be achieved.

Second, the user can freely adjust the pose to get the good and comfortable experience because the carrying assembly further includes the retractable rod and the linkage assembly for adjusting the pose.

The above-mentioned only exemplifies the swingable body carrier through the power-driven chair. However, the back frame, the seat frame and the foot frame can be changed in other embodiments. Alternatively, the quantity of the linkages and the support members can be reduced to allow the swingable body carrier being a power-driven bed or any other carrying furniture capable of achieving similar effects.

To sum up, the swingable body carrier of the abovementioned embodiment can provide a good swinging mode and is configured with the relative linkages for adjusting the pose. Thus, the present disclosure actually satisfies the needs of the public and the relative equipment's provider.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A swingable body carrier comprising:

a base having a plurality of connecting portions;

a reciprocating assembly having a plurality of swing arms and a swingable seat, wherein each of the swing arms has one end pivoted to the connecting portion and the other end extended downwardly to be pivoted to the swingable seat;

a power assembly providing a reciprocating power to allow the swingable seat moving reciprocatingly corresponding to the base and to allow the swing arms swinging reciprocatingly; and a carrying assembly provided for carrying a human body, wherein the carrying assembly is disposed at the swingable seat to move reciprocatingly along with the swingable seat and located above the swingable seat, wherein the carrying assembly comprises a transmission linkage, which has one end pivoted to the swingable seat, a power-driven retractable rod pivoted between the other end of the transmission linkage and the swingable seat and capable of being changed its length so as to drive the transmission linkage to swing, a seat frame having one end pivoted to the swingable seat, and a seat frame linkage pivoted between the seat frame and the transmission linkage to allow the transmission linkage to drive the seat frame linkage and the seat frame to swing.

2. The swingable body carrier of claim 1, wherein the swing arms are arranged in parallel with one another.

3. The swingable body carrier of claim 1, wherein a swinging area resulted from the reciprocatingly swinging of the swing arms has a swing angle not greater than 30 degrees.

4. The swingable body carrier of claim 1, wherein the power assembly is connected between the base and the swingable seat.

5. The swingable body carrier of claim 1, wherein the base further comprises a frame located lower than the swingable seat, a plurality of posts mounted on the frame, extended upwardly and arranged in surrounding the swingable seat, and two connecting rods separately mounted to the ends of the posts, being parallel to each other and having the connecting portions discretely disposed thereon.

6. The swingable body carrier of claim 1, wherein the transmission linkage comprises a body, which has an upper portion and a lower portion pivoted to the swingable seat, and two pivoting seats connected to the front side and the rear side of the upper portion of the body, wherein the power-driven retractable rod and the seat frame linkage are pivoted to the same pivoting seat, and the seat frame linkage is extended nonlinearly.

7. The swingable body carrier of claim 1, wherein the carrying assembly further comprises a back frame, which is pivoted to the seat frame, and a back frame linkage assembly comprising a first linkage, a second linkage and a third linkage, wherein one end of the first linkage, one end of the second linkage and one end of the third linkage are pivoted together, the other end of the first linkage is pivoted to the back frame, the other end of the second linkage is pivoted to the seat frame, and the other end of the third linkage is pivoted to the transmission linkage.

8. The swingable body carrier of claim 1, wherein the carrying assembly further comprises a crossed linkage assembly, a foot frame and a foot frame linkage, wherein the crossed linkage assembly has a proximal portion pivoted to the seat frame and a distal portion pivoted to the foot frame and further comprises a supporting portion, wherein the foot frame linkage is pivoted between the supporting portion and the transmission linkage.

9. The swingable body carrier of claim 8, wherein the supporting portion is located between the proximal portion and the distal portion.

* * * * *